US005715536A

United States Patent [19]

Banks

[11] Patent Number: 5,715,536

[45] Date of Patent: Feb. 10, 1998

[54] STATIC ELECTRICITY DISSIPATION GARMENT

[76] Inventor: David L. Banks, 21600 Lassen St., Chatsworth, Calif. 91311

[21] Appl. No.: 777,167

[22] Filed: Dec. 26, 1996

[51] Int. Cl.[6] ..... H05F 3/02; A41D 13/02

[52] U.S. Cl. ..... 2/69; 2/1; 361/212; 361/220

[58] Field of Search ..... 2/69, 1; 428/256, 428/259, 381; 174/5 SB, 5 R, 5 SG; 361/212, 220, 223, 224

[56] References Cited

U.S. PATENT DOCUMENTS

| | | | |
|---|---|---|---|
| 3,699,590 | 10/1972 | Webber et al. . | |
| 4,422,483 | 12/1983 | Zins . | |
| 4,596,053 | 6/1986 | Cohen et al. | 2/1 |
| 5,440,444 | 8/1995 | Adams | 361/212 X |
| 5,548,469 | 8/1996 | Adams | 361/220 |

*Primary Examiner*—C. D. Crowder
*Assistant Examiner*—Shirra L. Jenkins
*Attorney, Agent, or Firm*—Jack C. Munro

[57] ABSTRACT

A static electricity dissipation garment where the body of the garment is constructed of fabric within which is woven the strands of carbon. The garment includes a pair of side seams located between the torso area of the garment and down each leg section of the garment. The first embodiment of the garment includes sleeve seams that extend along the entire length of the sleeve of the garment and along the connection of the sleeve to the upper torso and then along the collar of the garment. Within each of these seams, along the entire length of the seam, is included an electrically conductive ribbon. The ribbon of the side seam is designed to overlap a substantial length of the sleeve seam. The ribbons of the two sleeve seams and side seams overlap each other in the area of the collar. An appropriate electrical connector is connected to the ribbon of at least one side seam. An electrical conductor is to be connected to the electrical connector which is to function to remove static electricity that accumulates on the garment. A second embodiment of garment has each side seam extending down each sleeve and terminates at the cuff. Transverse ribbons are mounted across the torso section of the garment which provide a dual pair of electrical connectors each of which may be used to remove static electricity.

4 Claims, 3 Drawing Sheets

STATIC ELECTRICITY DISSIPATION GARMENT

BACKGROUND OF THE INVENTION

1. Field of the Invention

The field of this invention relates to garments and more particularly to a garment that is designed primarily to minimize static electricity generated in a controlled environment (clean room).

2. Description of the Prior Art

During the manufacturing of certain equipment, there is a need for the workers involved to be as free as possible of static electricity. Typically, electronic equipment construction, such as disc drives, requires a near static-free environment. In the past, as long as the people involved in disc drive manufacturing generated less than a couple hundred volts of static electricity, the process was not adversely affected. Recently, however, disc drives having a higher degree of sensitivity are being created, and it has become mandatory that workers have less than twenty volts of static electricity on their person. This is an exceedingly small amount of static electricity, particularly in view of the fact that the mere act of moving an arm through the air would normally generates at least that amount of voltage.

SUMMARY OF THE INVENTION

The primary objective of the present invention is to construct a static electricity dissipation garment which will result in the person wearing the garment generating less than twenty volts of static electricity at any given time.

Another objective of the present invention is to construct a static electricity dissipation garment which is manufactured in a simple manner and therefore can be constructed inexpensively and ultimately sold at a relatively inexpensive price to the consumer.

The static elimination garment of the present invention is constructed of a one hundred percent polyester monofilament fabric material which is intended to be worn as an overgarment covering clothes worn by the user. The body of the garment is constructed of fabric, and within this fabric are weaved strands of carbon with these strands forming a crisscross pattern within the body of the garment. The garment includes a pair of leg sections that is located in juxtaposition which is connected to the lower end of a torso section. From each side of the torso section is mounted a sleeve section with the two sleeve sections being mounted at the upper end of the torso section terminating in a neck opening which is surrounded by a collar. The garment includes a side seam at each side of the garment. The side seam extends the entire length of the leg section and about half the length of the torso section terminating in the underarm area directly adjacent a sleeve section. There is a sleeve seam that extends all the way down the length of each sleeve terminating at the outer end of the seam in the cuff area which is to be placed around the wrist of the user. The inner end of the sleeve seam is positioned at the connection between the torso section and the sleeve and terminates in the collar surrounding the neck opening. Sewn within each of the seams, and electrically connecting with the numerous cross strands of carbon fibers sewn into the body of the garment, are electrically conductive ribbons. The electrically conductive ribbon of each side seam also continues down the sleeve seam almost to the cuff with the electrically conductive ribbon of the side seam overlapping with this portion of the electrically conductive ribbon mounted within the sleeve seam. At the collar, the electrically conductive ribbons of both sleeve seams overlap each other. An output electrical connector is mounted within each side seam and respectively electrically connects with the ribbon of its side seam. It is to be understood that there are two separate electrical connectors. Each electrical connector is capable of being connected to an output electrical conducting wire with this wire to then be connected to an appropriate grounding connector on the exterior structure.

DETAILED DESCRIPTION OF THE PREFERRED EMBODIMENT

Figures 1, 2, 3, 4:
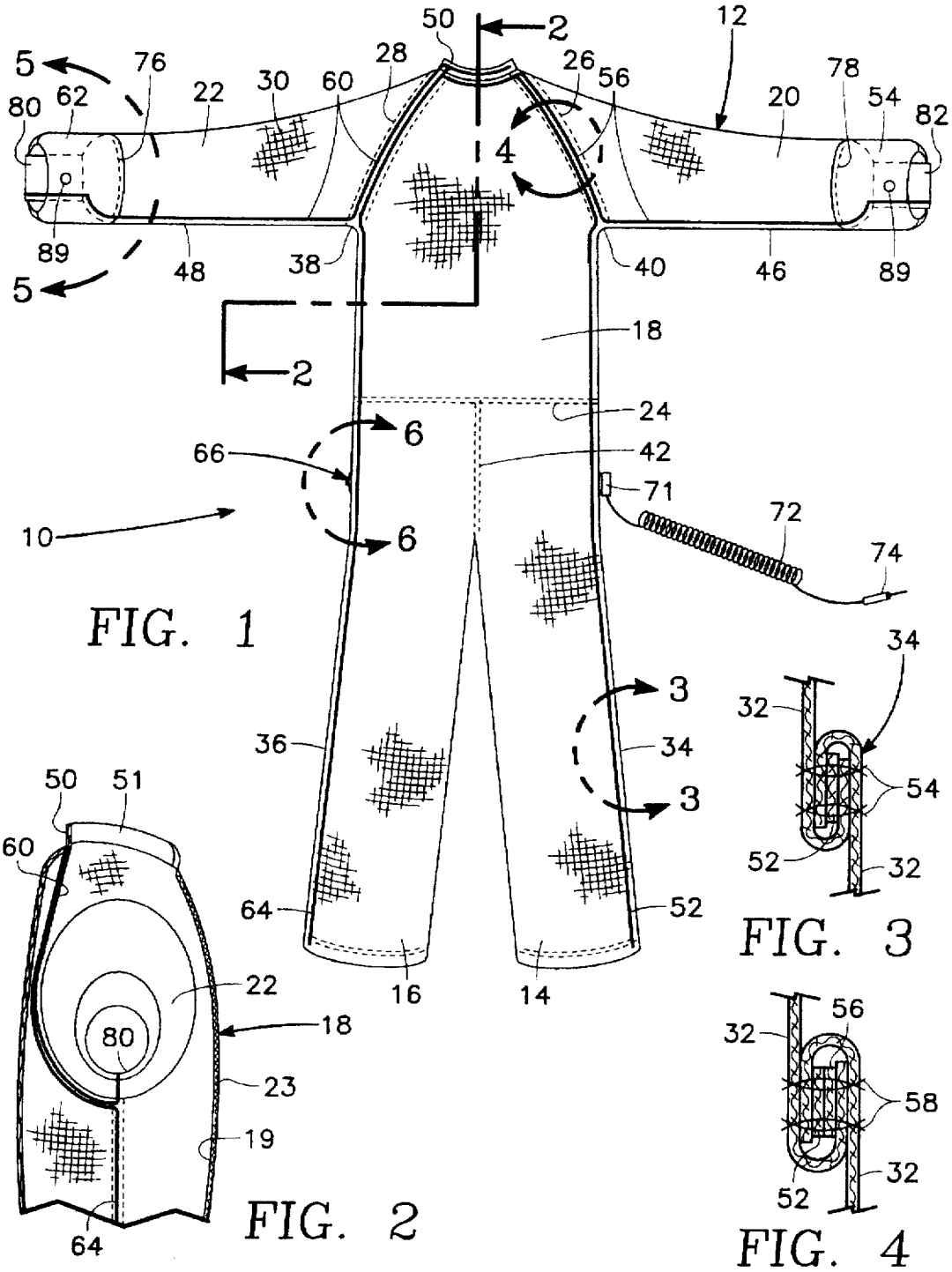
FIG. 1 shows a back view of a first embodiment of static electricity dissipation garment of the present invention.
FIG. 2 is a cross-sectional view taken along line 2—2 of FIG. 1 showing the neck opening within the collar and also showing the hollow interior of the garment.
FIG. 3 is a cross-sectional view taken through one of the leg seams incorporated within the garment of the present invention taken along line 3—3 of FIG. 1.
FIG. 4 is a cross-sectional view taken through one of the sleeve seams incorporated within the garment of the present invention taken along line 4—4 of FIG. 1.

Referring particularly to the drawings, there is shown in FIGS. 1 and 2 the first embodiment of garment 10 constructed in accordance with this invention. The garment 10 is formed of a body 12 with this body 12 defining a pair of leg sections 14 and 16, a torso section 18 and a pair of sleeves 20 and 22. The leg sections 14 and 16 are connected at seam 24 to the lower end of the torso section 18. The leg sections 14 and 16 are joined together at seam 42. Sleeve 20 is connected by seam 26 to torso section 18. Sleeve 22 connects by seam 28 to torso section 18. The leg sections 14 and 16 are basically identical and of the same length and are located in juxtaposition. The sleeves 20 and 22 are also basically identical and are aligned and extend in opposite directions away from the torso section 18.

Typical material of construction of the body 12 of the garment would be a polyester type of fabric 32 within which are woven strands 30 of carbon. Typically the strands 30 are spaced about one-quarter of an inch apart and are located in a crisscross pattern forming a checkerboard appearance.

Leg section 14 is constructed of the fabric 32 which is formed into a tubular configuration and seamed together at side seam 34. The torso section 18 is also formed into a tubular configuration forming internal compartment 19 and is connected together at a seam that aligns with and forms part of the side seam 34 terminating at underarm area 40. In a similar manner, the leg section 16 is formed into the side seam 36 with this side seam 36 extending onto the torso section 18 terminating at underarm area 38. The front portion of the torso section 18 includes a zipper 23 which is to be manipulated by the user as needed.

The lower ends of each of the leg sections 14 and 16 are seamed together with the fabric 32 being overlapped upon itself. A similar type of seam arrangement is located in the seam 42 connecting together the leg sections 14 and 16 and also in seam 24 which connects leg sections 14 and 16 with torso section 18. It is to be understood that the lower end of each of the leg sections 14 and 16 will be open.

Sleeve 20 is also formed to be tubular with there being formed a sleeve seam 46. A similar sleeve seam 48 is formed within sleeve 22. Sleeve seam 46 connects with seam 26 which terminates at a collar 50. The collar 50 surrounds neck opening 51 of the garment 10.

A continuous length of electrically conductive ribbon 52 is sewn by threads 54 within overlapped sections of fabric 32 of side seam 34. The ribbon 52 has a width of about one-fourth of an inch and is about the thickness of conventional fabric. The ribbon 52 is basically constructed of a polyester and nylon fabric with there being incorporated in the ribbon a mass of closely spaced apart carbon fibers. The result is the electrically conductive ribbon 52 comprises an electrical conductor. The electrically conductive ribbon 52 extends from the outer end of the leg section 14 along the entire length of the leg section 14 to the underarm area 40 of the torso section 18. From there, the electrically conductive ribbon 52 extends along seam 26 to the collar 50. Formed within the cuff 54 is the second length of ribbon 56 which is sewn by threads 58 in abutting contact with the electrically conductive ribbon 52. Therefore, the electrically conductive ribbons 52 and 56 overlap in the area of the upper torso of the garment 10. This overlapping helps insure that a positive electrical connection is continuously established between the ribbons 52 and 56. A similar ribbon 60 extends from the cuff 62 of the sleeve 22 with this ribbon 60 being conducted along the seam 28 to the collar 50. It can be seen in the area of the collar 50 that several inches of both ribbons 56 and 60 overlap. Within the area of the collar 50, these ribbons are to be tightly sewn together. It is to be understood that there is a ribbon 64 formed within the seam 36 with this ribbon 64 extending from the collar 50 the total length of the side seam 36.

It is to be understood that any static electricity accumulated on the body 12 of the garment 10 is conducted by the carbon fibers 30 to one of the ribbons 52, 56, 60 or 64. Mounted on the side seam 36 is an electrical connector 66. It is to be understood that a similar electrical connector (not shown) is mounted in conjunction with the side seam 34. The electrical connector 66 comprises a female member 68 and a male member 70. The male member 70 is inserted within the female member 68 with sections of the ribbons 60 or 64 as well as layers of the fabric 32 being tightly bound there between. A positive electrical connection is subsequently formed with the side seam 36 and also a similar electrical connection is formed with the side seam 34. The electrical connector 66 is to be connected to socket 71 which is attached to an electrically conductive wire 72 which is shown being connected with the electrical connector mounted in conjunction with the side seam 34. It is to be understood that there may be utilized only one electrical conductive wire 72 which is connected only with one of the electrical connectors 66 but not both at the same time. The electrically conductive wires 72 include a plug 74 which is to be connected with an appropriate female socket (not shown) of an exterior grounding connector. The accumulated static electricity from a garment is then discharged through the electrically conductive wire or wires 72 to the appropriate electrical ground.

It is to be noted that the entire garment 10 is constructed in a manner that facilitates normal cleaning without impacting its effectiveness in the minimizing of static electricity over an extended period of time.

Figure 5:
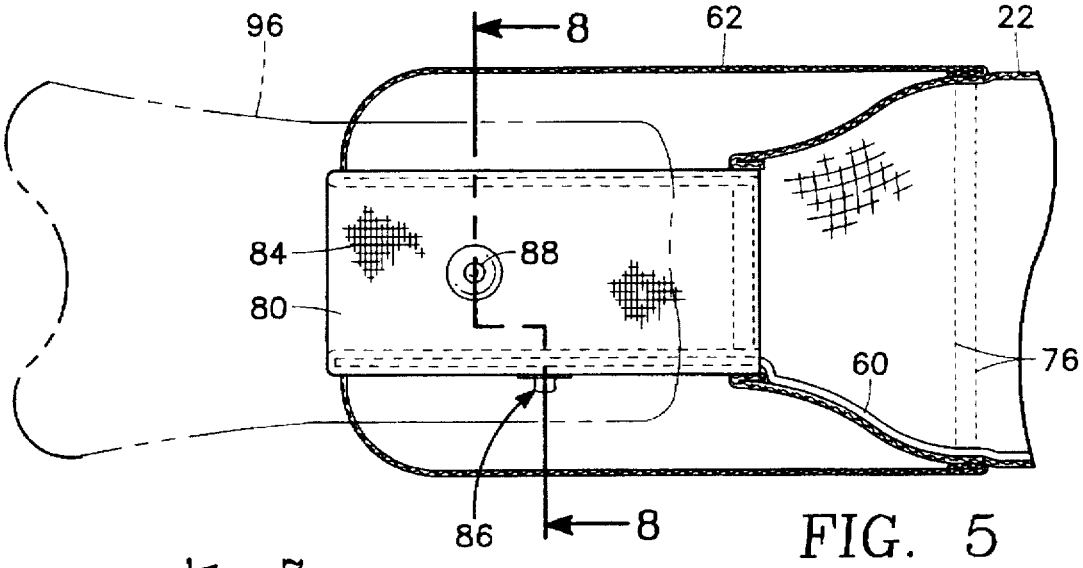
FIG. 5 is an enlarged view of one of the cuff areas which form the outer end of the sleeve of the garment of the present invention taken along line 5—5 of FIG. 1.
Figure 6:
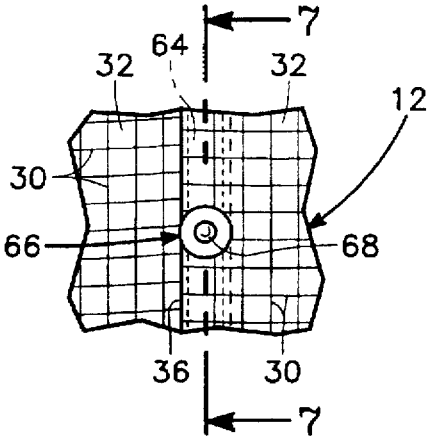
FIG. 6 is an enlarged view showing more clearly the electrical connector that is mounted in conjunction with one of the side seams of the garment taken along line 6—6 of FIG. 1.
Figure 7:
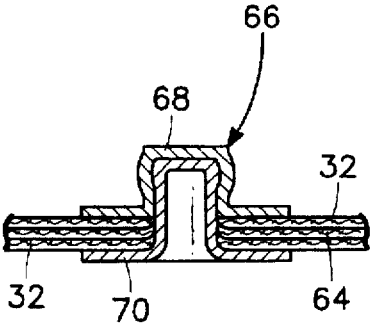
FIG. 7 is a cross-sectional view taken along line 7—7 of FIG. 6.
Figure 8:
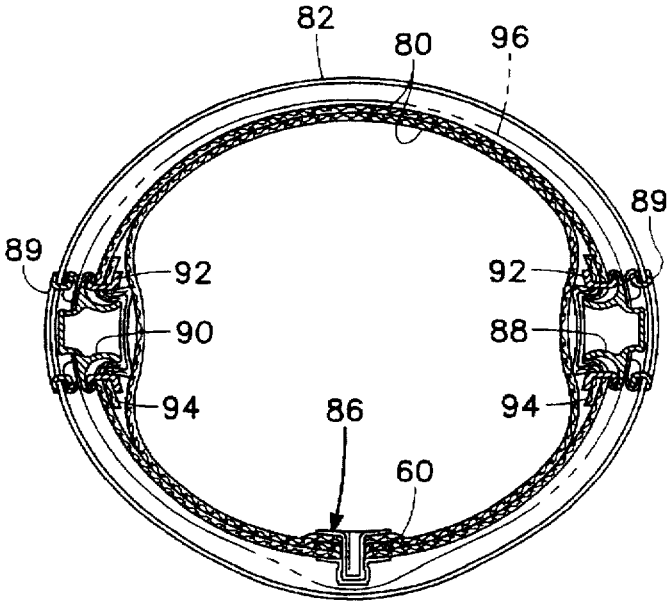
FIG. 8 is a cross-sectional view through the cuff of the garment taken along line 8—8 of FIG. 5.

Referring particularly to FIGS. 5 and 8 of the drawings, there is a fabric cuff 62 that is sewn at seam 76 to the sleeve 22. It is to be understood that the fabric cuff 54 is sewn also at seam 78 to the sleeve 20. The cuffs 62 and 54 are essentially identical. The sleeve 22 terminates in a fabric tubular section 80. The sleeve 20 terminates in a similar manner in a fabric tubular section 82. Each of the fabric tubular sections 80 and 82 have sewn therein a mass of carbon fibers 84. Ribbon 60 is sewn in conjunction with the tubular section 80. An electrical connector 86, which is basically identical to the electrical connector 66, is mounted in conjunction with overlapped sections of tubular section 80 with the ribbon 60 being bound there between. An appropriate electrical connection is now provided with the tubular section 80. It is to be understood that the tubular section 80 will expand to permit passage therethrough of the user's hand with the tubular section 80 to rest on the wrist of the user. The tubular section 80 is to be placed on the right wrist of the user with the tubular section 82 to be located on the left wrist of the user. Also mounted in conjunction with the tubular section 80 is a pair of snap fasteners 88 and 90. A pair of female fasteners 89 are mounted on the cuff 80 with each fastener 89 to connect with snap fasteners 88 and 90. These fasteners 88 and 90 are also to facilitate connection with a glove 96 that is to be worn by the user. The glove body is clamped between fasteners 89 and 88 and also between fasteners 89 and 90. It is to be understood that the wearing of a static dissipating glove is required. The snap fasteners 88 and 90 are each attached to tubular section 80 by means of a ring 92 which is snugly mounted about the rear portion of the snap fasteners 88 and 90. To prevent the ring 92 from cutting the tubular section 80, there is inserted a small insert piece 94 of fabric between ring 92 and tubular section 80.

Figure 9:
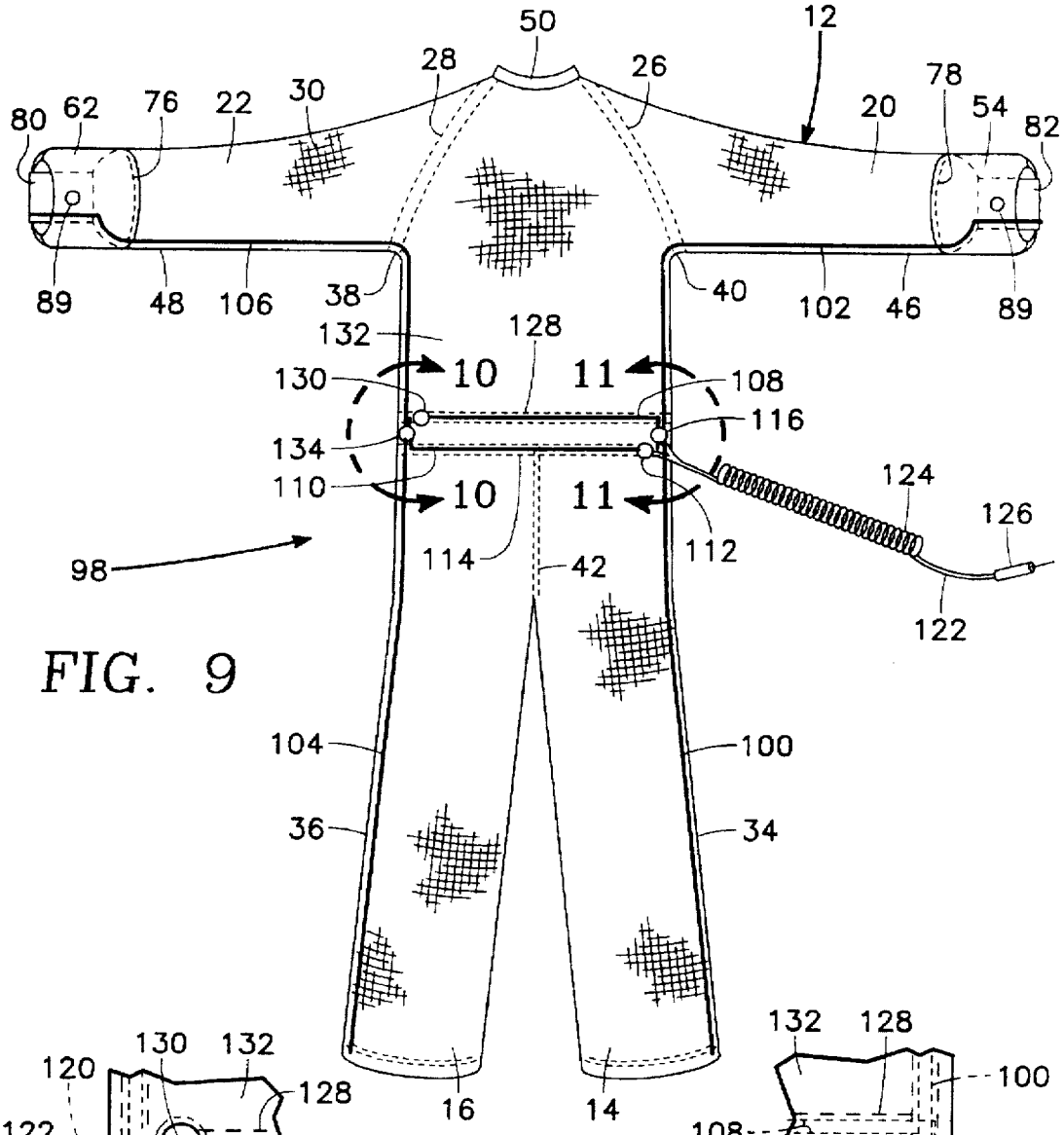
FIG. 9 is a front view of the second embodiment of a static electricity dissipation garment of the present invention.
Figure 10:
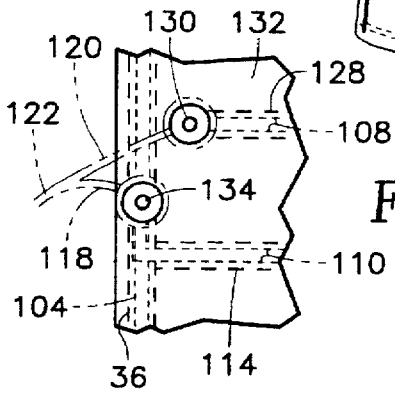
FIG. 10 is an enlarged view of the connector arrangement utilized in conjunction with the second embodiment of this invention taken along line 10—10 of FIG. 9.
Figure 11:
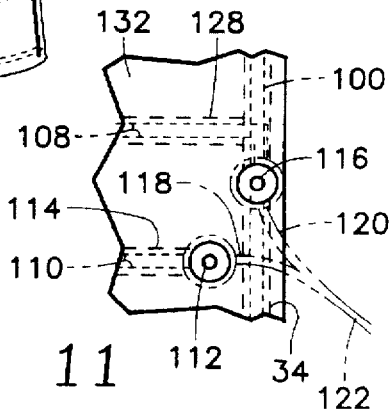
FIG. 11 is an enlarged view of further connector arrangement utilized in conjunction with the second embodiment of a static electricity dissipation garment of this invention taken along line 11—11 of FIG. 9.

Referring particularly to FIG. 9 of the drawings, there is shown the second embodiment 98 of garment 132 of this invention. Like numerals have been employed relative to the garment 10 to refer to like parts. The second embodiment 98 of the garment of this invention has an electrically conductive ribbon 100 which is mounted within the side seam 34 with this ribbon 100 extending also along the sleeve seam 46. This electrically conductive ribbon 100 within the sleeve seam 46 terminates in a cuff section 102.

Within the side seam 36, there is mounted an electrically conductive ribbon 104 which is conducted along the sleeve seam 48 and terminates in a cuff section 106. Electrically connecting with the ribbon 100 is a transverse section 108 of ribbon. A similar transverse section 110 of electrically conductive ribbon is electrically connected with the electrically conductive ribbon 104. The outer end of the transverse section 108 is located directly adjacent the electrically conductive ribbon 104. In a similar manner, the outer end of the transverse section 110 is located directly adjacent the ribbon 100.

Mounted in conjunction with the outer end of transverse section 110 and electrically connecting with same is an electrical connector 112. The transverse section 110 is mounted in conjunction with a transverse seam 114. The electrical connector 112 is basically identical to the electrical connector 86. A similar electrical connector 116 is mounted in conjunction with the ribbon 100 at the seam 34. An electrically conductive wire 118 electrically connects with the connector 112 with a second wire 120 electrically connecting with the connector 116. The electrically conductive wires 118 and 120 are joined within and from conductor 122 which is to be wound into a coil 124. The conductor 122 terminates in a plug connector 126. The plug connector 126 is to be plugged into an electrical conducting socket which is not shown and has been previously discussed in relation to the plug connector 74. The coil 124 is to be expandable so as to permit the individual wearing the garment 98 to move within a confined area and can still remain electrically connected by the plug connector 126.

The transverse section 108 is mounted within a cross seam 128. The outer end of the transverse section 108 is electrically connected to a connector 130 that is mounted within the garment 132. A further connector 134 is mounted in conjunction with the ribbon 104 and located within the seam 36.

The user has the option of connecting the conductor 122 either to connectors 116 and 112 or to connectors 130 and 134. If the conductor 122 is connected to the connectors 112 and 116, the conductor 122 is connected to the left side of the users body. If the user has selected the conductor 122 to be connected to connectors 130 and 134, the conductor 122 is connected to the right side of the users body. With either connection, total extraction of the static electricity from the garment 132 is achieved.

What is claimed is:

1. A static electricity dissipation garment comprising:

said garment having a pair of leg sections located in juxtaposition and connected to a torso section and two sleeves which are in alignment with each other and which extend from said torso section each in an opposite direction, said torso section having a collar enclosing a neck opening at its upper end, each said sleeve terminating in a cuff at its outer end;

said garment being constructed of a fabric which is impregnated throughout with electrically conductive threads;

said garment having a pair of side seams and a pair of sleeve seams, each said side seam extends between said torso section and a said leg section, each said sleeve seam extends between a said sleeve and said torso section ending at said collar, an electrically conductive ribbon mounted within each said side seam and sleeve seam, said electrically conductive ribbon extending the entire length of each said side seam, said ribbon within each said side seam overlapping said ribbon of a said sleeve seam, said ribbon within said sleeve seams overlapping a portion of each other; and an electrical connector connecting with one of said seams, said electrical connector connecting with a grounding wire, said grounding wire extending from said garment and adapted to connect with an exterior grounding connector.

2. The static electricity dissipation garment as defined in claim 1 wherein:

a portion of said ribbon within a said side seam overlaps said ribbon of a said sleeve by extending substantially the entire length of said sleeve.

3. The static electricity dissipation garment as defined in claim 1 wherein:

said ribbons of both said sleeves extend across a portion of said collar.

4. The static electricity dissipation garment as defined in claim 1 wherein:

a first transverse section of electrically conductive ribbon being mounted across said torso and extending within one of said side seams, a second transverse section of electrically conductive ribbon extending across said torso section and connecting with the other of said side seams, a first pair of electrical connectors connecting between said first transverse section and one of said side seams, a second pair of electrical connectors connecting between said second transverse section and the other of said side seams, whereby the user is able to select a connection with either said first pair of electrical connectors or said second pair of electrical connectors.

* * * * *

UNITED STATES PATENT AND TRADEMARK OFFICE

CERTIFICATE OF CORRECTION

PATENT NO. : 5,715,536

DATED : February 10, 1998

INVENTOR(S) : David L. Banks

It is certified that error appears in the above-indentified patent and that said Letters Patent is hereby corrected as shown below:

The address of the inventor, David L. Banks, should read as:

7362 W. 87th St.
Los Angeles, California 90045

Signed and Sealed this

Fifth Day of May, 1998

Bruce Lehman

*Attest:*

BRUCE LEHMAN

*Attesting Officer*

*Commissioner of Patents and Trademarks*